US011436994B2

(12) United States Patent
Chen et al.

(10) Patent No.: US 11,436,994 B2
(45) Date of Patent: Sep. 6, 2022

(54) METHOD FOR ADJUSTING WHITE BALANCE OF PIXEL, DISPLAY PANEL AND COMPUTER READABLE STORAGE MEDIUM

(71) Applicant: HKC CORPORATION LIMITED, Guangdong (CN)

(72) Inventors: Wei Chen, Guangdong (CN); Chongwei Tang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/190,616

(22) Filed: Mar. 3, 2021

(65) Prior Publication Data

US 2022/0036856 A1 Feb. 3, 2022

(30) Foreign Application Priority Data

Jul. 28, 2020 (CN) ..... 202010749350.3

(51) Int. Cl.
*G09G 5/06* (2006.01)
*G09G 5/10* (2006.01)

(52) U.S. Cl.
CPC ..... *G09G 5/06* (2013.01); *G09G 5/10* (2013.01); *G09G 2320/0666* (2013.01)

(58) Field of Classification Search
CPC .... G09G 5/06; G09G 5/10; G09G 2320/0271; G09G 2320/0666; G09G 2320/0673; G09G 3/3648; G09G 5/005; G09G 5/006
See application file for complete search history.

(56) References Cited

U.S. PATENT DOCUMENTS

2019/0327526 A1 10/2019 Navin et al.

FOREIGN PATENT DOCUMENTS

| | | | |
|---|---|---|---|
| CN | 104916267 A | | 9/2015 |
| CN | 105304048 A | | 2/2016 |
| CN | 107358933 A | * | 11/2017 |
| CN | 107358933 A | | 11/2017 |
| CN | 108320723 A | | 7/2018 |
| CN | 109285506 A | * | 1/2019 |

(Continued)

OTHER PUBLICATIONS

Chinese Office Action, dated Feb. 3, 2021, for Hui ke co., ltd., Chinese Application No. 202010749350.3, filed Jul. 28, 2020.

(Continued)

*Primary Examiner* — Robert J Michaud
(74) *Attorney, Agent, or Firm* — Law Offices of Albert Wai-Kit Chan, PLLC

(57) ABSTRACT

Disclosed is a method for adjusting a white balance of a pixel. The method includes the following operations: determining a proportion of each primary light corresponding to a pixel to be displayed in a current frame display picture, and determining a picture type of the current frame display picture; determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed. A display device and a computer readable storage medium are further disclosed.

17 Claims, 5 Drawing Sheets

(56) References Cited

FOREIGN PATENT DOCUMENTS

| | | | | |
|---|---|---|---|---|
| CN | 109285506 | A | | 1/2019 |
| CN | 110164356 | A | * | 8/2019 |
| CN | 110164356 | A | | 8/2019 |
| CN | 111083854 | A | | 4/2020 |
| CN | 111312191 | A | | 6/2020 |

OTHER PUBLICATIONS

Chinese Office Action, dated May 11, 2021, for Hui ke co., ltd., Chinese Application No. 202010749350.3, filed Jul. 28, 2020.

* cited by examiner

METHOD FOR ADJUSTING WHITE BALANCE OF PIXEL, DISPLAY PANEL AND COMPUTER READABLE STORAGE MEDIUM

CROSS-REFERENCE TO RELATED APPLICATIONS

The present disclosure claims priority to Chinese Application No. 202010749350.3, filed on Jul. 28, 2020, the entire disclosure of which is incorporated herein by reference.

TECHNICAL FIELD

The present disclosure relates to the technical field of display devices, in particular to a method for adjusting a white balance of a pixel, a display panel, and a computer readable storage medium.

BACKGROUND

When the display panel displays a picture, the color of the display picture is not necessarily the same as the color perceived by the human eye. Therefore, the display panel needs to adjust the color of the display picture to conform to human visual habits, and this adjustment method is white balance adjustment. In an exemplary technology, the display panel adjusts the white balance by adjusting the proportion of the corresponding primary light of each pixel of the display picture.

The refresh rate refers to the number of times the electron beam repeatedly scans the image on the screen. The higher the refresh rate, the shorter the charging time of the thin film transistor corresponding to the pixel, and the corresponding proportion of the primary light corresponding to the pixel will change. However, the adjustment of the proportion of each primary light is fixed. When the refresh rate changes, adjusting the white balance of the pixel is not accurate.

SUMMARY

The main objective of the present disclosure is to provide a method for adjusting a white balance of a pixel, a display panel, and a computer readable storage medium, which aims to solve the problem of inaccuracy of adjusting the white balance of the pixel.

In order to achieve the above objective, the present disclosure provides a method for adjusting a white balance of a pixel, including the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

In an embodiment, the operation of determining a target proportion correction value of each primary light according to the target refresh rate includes:

determining a proportion correction value corresponding to each primary light, and determining a correction parameter corresponding to each primary light according to the target refresh rate; and correcting the proportion correction value of each primary light according to the correction parameter of each primary light to obtain the target proportion correction value.

In an embodiment, the operation of determining a proportion correction value corresponding to each primary light includes:

determining a look-up table of the proportion and the proportion correction value of each primary light; and determining the proportion correction value of each primary light in the look-up table according to the proportion of each primary light corresponding to the pixel to be displayed.

In an embodiment, the operation of determining a correction parameter corresponding to each primary light according to the target refresh rate includes:

obtaining a preset refresh rate; and determining the correction parameter corresponding to each primary light according to a difference between the target refresh rate and the preset refresh rate.

In an embodiment, when adjusting the white balance of the pixel to be displayed, proportions of blue light and red light corresponding to the pixel to be displayed are adjusted.

In an embodiment, the picture type includes a dynamic picture and a static picture, the operation of determining a target refresh rate according to the picture type includes:

obtaining a preset refresh rate;

increasing the preset refresh rate to obtain the target refresh rate when the picture type is the dynamic picture; and reducing the preset refresh rate to obtain the target refresh rate when the picture type is the static picture.

In an embodiment, the operation of determining a picture type of the current frame display picture includes:

obtaining a previous frame display picture;

determining a second pixel of the previous frame display picture corresponding to a first pixel of the current frame display picture, and comparing a pixel value of the first pixel with a pixel value of the second pixel;

determining that the picture type of the current frame display picture is a static picture when a number of first pixels whose pixel values are same as pixel values of second pixels corresponding to the first pixels is greater than a first preset number; and determining that the picture type of the current frame display picture is a dynamic picture when a number of first pixels whose pixel values are different from pixel values of second pixels corresponding to the first pixels is greater than a second preset number In an embodiment, after the operation of determining a target proportion of each primary light according to the target proportion correction value and a value of the proportion to adjust the white balance of the pixel to be displayed, the method further includes:

determining a display time point of a next frame display picture according to the target refresh rate after the white balance of the pixel to be displayed is adjusted, and after each pixel on the current frame display picture is displayed on a display panel; and taking the next frame display picture as the current frame display picture when the display time point arrives, to perform the operation of determining a proportion of each primary light corresponding to a pixel to be displayed in a current frame display picture.

In order to achieve the above objective, the present disclosure further provides a display device, the display device includes a memory and at least one processor, the memory stores computer-executable instructions executed by the at least one processor, and when the computer-executable instructions are executed by the at least one processor, the at least one processor performs the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

In order to achieve the above objective, the present disclosure further provides a computer readable storage medium, the computer readable storage medium includes computer-executable instructions executed by at least one processor, and when the computer-executable instructions are executed by the at least one processor, the at least one processor performs the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

The present disclosure provides a method for adjusting a white balance of a pixel, a display panel, and a computer readable storage medium. The method includes: determining a proportion of each primary light corresponding to a pixel to be displayed in a current frame display picture, and determining a picture type of the current frame display picture; determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed. Since the display panel can adjust the refresh rate according to the picture type of the current frame display picture, and determine the target proportion correction value of each primary light according to the adjusted refresh rate, the target proportion of each primary light of the pixel to be displayed is adjusted correspondingly with the change of the refresh rate, and the accuracy of the white balance adjustment of the pixel is high.

The realization of the objective, functional characteristics, and advantages of the present disclosure are further described with reference to the accompanying drawings.

DETAILED DESCRIPTION OF THE EMBODIMENTS

It should be understood that the specific embodiments described herein are only used to explain the present disclosure, but not to limit the present disclosure.

A solution of the embodiments of the present disclosure is: determining a proportion of each primary light corresponding to a pixel to be displayed in a current frame display picture, and determining a picture type of the current frame display picture; determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed. The target refresh rate and the proportion correction value of each primary light have a positive correlation.

Since the display panel can adjust the refresh rate according to the picture type of the current frame display picture, and determine the target proportion correction value of each primary light according to the adjusted refresh rate, the target proportion of each primary light of the pixel to be displayed is adjusted correspondingly with the change of the refresh rate, and the accuracy of the white balance adjustment of the pixel is high.

Figure 1:
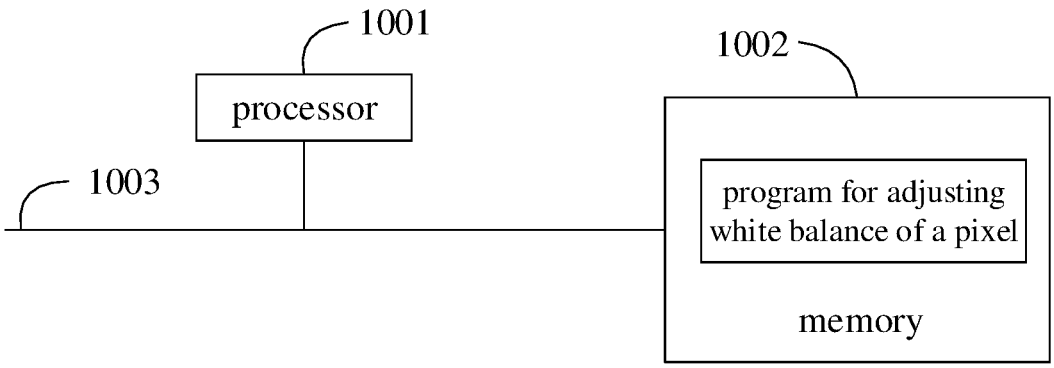
FIG. 1 is a schematic diagram of a hardware architecture of a display panel according to an embodiment of the present disclosure.

As an implementation scheme, the display panel may be shown in FIG. 1.

The embodiment of the present disclosure relates to a display panel. The display panel includes a processor 1001, such as a CPU, a memory 1002, and a communication bus 1003. The communication bus 1003 is used to realize connection and communication between those components.

The memory 1002 may be a high-speed Random Access Memory (RAM), or a stable memory (non-volatile memory), such as a disk memory. As shown in FIG. 1, the memory 1003, as a computer storage medium, may include a program for adjusting a white balance of a pixel. The processor 1001 may call the program for adjusting the white balance of the pixel stored in the memory 1002, and perform the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

In an embodiment, the processor 1001 may call the program for adjusting the white balance of the pixel stored in the memory 1002, and perform the following operations:

determining a proportion correction value corresponding to each primary light, and determining a correction parameter corresponding to each primary light according to the target refresh rate; and correcting the proportion correction value of each primary light according to the correction parameter of each primary light to obtain the target proportion correction value.

In an embodiment, the processor 1001 may call the program for adjusting the white balance of the pixel stored in the memory 1002, and perform the following operations:

determining a look-up table of the proportion and the proportion correction value of each primary light;

determining the proportion correction value of each primary light in the look-up table according to the proportion of each primary light corresponding to the pixel to be displayed.

In an embodiment, the processor 1001 may call the program for adjusting the white balance of the pixel stored in the memory 1002, and perform the following operations:

obtaining a preset refresh rate; and determining the correction parameter corresponding to each primary light according to a difference between the target refresh rate and the preset refresh rate.

In an embodiment, the processor 1001 may call the program for adjusting the white balance of the pixel stored in the memory 1002, and perform the following operations:

when adjusting the white balance of the pixel to be displayed, adjusting proportions of blue light and red light corresponding to the pixel to be displayed.

In an embodiment, the processor 1001 may call the program for adjusting the white balance of the pixel stored in the memory 1002, and perform the following operations:

obtaining a preset refresh rate;

increasing the preset refresh rate to obtain the target refresh rate when the picture type is the dynamic picture; and reducing the preset refresh rate to obtain the target refresh rate when the picture type is the static picture.

In an embodiment, the processor 1001 may call the program for adjusting the white balance of the pixel stored in the memory 1002, and perform the following operations:

obtaining a previous frame display picture;

determining a second pixel of the previous frame display picture corresponding to a first pixel of the current frame display picture, and comparing a pixel value of the first pixel with a pixel value of the second pixel;

determining that the picture type of the current frame display picture is a static picture when a number of first pixels whose pixel values are same as pixel values of second pixels corresponding to the first pixels is greater than a first preset number; and determining that the picture type of the current frame display picture is a dynamic picture when a number of first pixels whose pixel values are different from pixel values of second pixels corresponding to the first pixels is greater than a second preset number.

In an embodiment, the processor 1001 may call the program for adjusting the white balance of the pixel stored in the memory 1002, and perform the following operations:

determining a display time point of a next frame display picture according to the target refresh rate after the white balance of the pixel to be displayed is adjusted, and after each pixel on the current frame display picture is displayed on a display panel; and taking the next frame display picture as the current frame display picture when the display time point arrives, and perform the operation of determining a proportion of each primary light corresponding to a pixel to be displayed in a current frame display picture.

In this embodiment, the display panel determines a proportion of each primary light corresponding to a pixel to be displayed in a current frame display picture, and determines a picture type of the current frame display picture, thereby determines a target refresh rate according to the picture type; and determines a target proportion correction value of each primary light according to the target refresh rate, determines a target proportion of each primary light according to the target proportion correction value and a value of the proportion to adjust the white balance of the pixel to be displayed. Since the display panel can adjust the refresh rate according to the picture type of the current frame display picture, and determine the target proportion correction value of each primary light according to the adjusted refresh rate, the target proportion of each primary light of the pixel to be displayed is adjusted correspondingly with the change of the refresh rate, and the accuracy of the white balance adjustment of the pixel is high.

Based on the above hardware architecture, the present disclosure provides a method for adjusting a white balance of a pixel.

Figure 2:
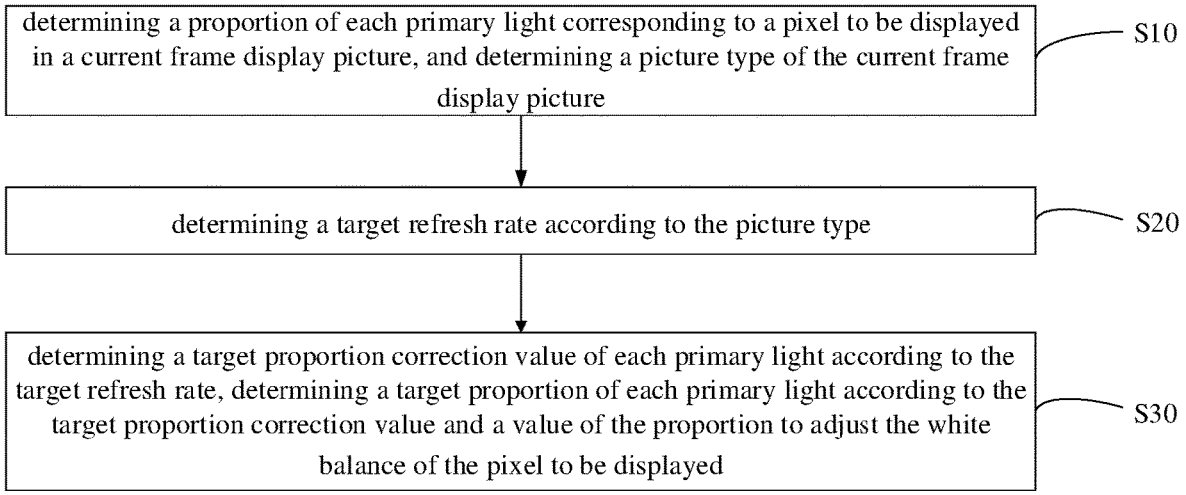
FIG. 2 is a schematic diagram of a method for adjusting a white balance of a pixel according to an embodiment of the present disclosure.

As shown in FIG. 2, FIG. 2 is a schematic diagram of a method for adjusting a white balance of a pixel according to an embodiment of the present disclosure. The method includes the following operations:

Operation S10, determining a proportion of each primary light corresponding to a pixel to be displayed in a current frame display picture, and determining a picture type of the current frame display picture.

In this embodiment, the executive subject of this method is the display panel. Before the display panel displays the display picture, it is necessary to adjust the white balance of the pixel, such that the picture displayed by the display panel conforms to the visual habit of the human eye, that is, the white displayed on the display panel is perceived by the human eye as white instead of other colors.

When the white balance of the pixel is adjusted, it is to adjust the proportion of each primary light corresponding to the pixel without changing the brightness value of the pixel. For example, the color displayed by the pixel is white, and the ratio of blue, green, and red light corresponding to the pixel is 2:1:1 (the ratio of blue light is more, the color temperature is higher), then the ratio after adjusting the white balance is 1:2:2. After adjustment, the ratio of blue light is reduced, and the ratio of green light and red light is increased, so that the image of the pixel displayed on the display panel is white, and the color perceived by the human eye is also white.

The display panel adjusts the white balance of the pixel so that the displayed white image and the color perceived by the human eye are also white, thereby the displayed color of the image of other colors perceived by the human eye is consistent with the displayed color.

After the display panel receives the image signal, it parses the image signal to obtain the current frame display picture, and the current frame display picture is the image to be displayed. The current frame display picture includes multiple pixels, each pixel has a corresponding color. The color is obtained by mixing the three primary lights of red light, green light and blue light, that is, the color of the pixel can be determined by the proportion of the three primary lights, and the proportion is determined by the ratio of the three primary lights. Since there are many pixels in the current frame display picture, analyzing the image signal to obtain the proportion of each primary light corresponding to each pixel is the compressed data. The display panel needs to further decompress the parsed data to obtain the proportion of each primary light corresponding to each pixel.

Figure 3:
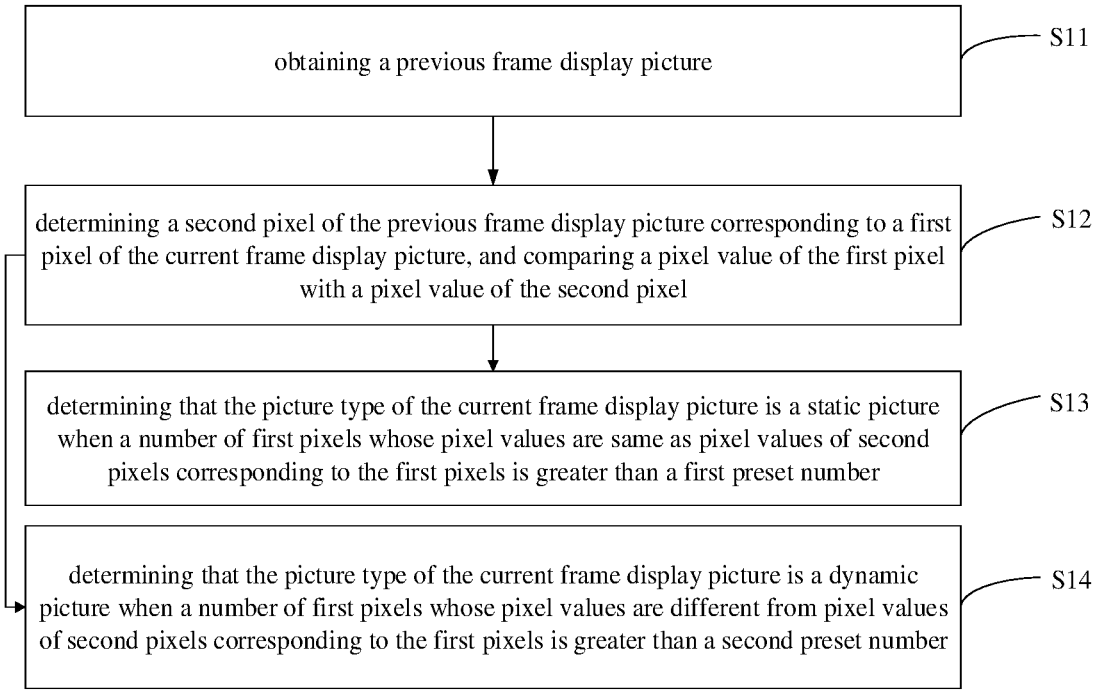
FIG. 3 is a detailed flowchart of the operation S10 of determining a picture type of the current frame display picture; determining a target refresh rate according to the picture type in FIG. 2.

The display picture is divided into multiple picture types. The picture type includes a dynamic picture and a static picture. The display panel is provided with a Double Data Rate (DDR) for storing the grayscale value of each pixel in the previous frame display picture. The display panel can determine the picture type of the current frame display picture by comparing the current frame display picture with the previous frame display picture. As shown in FIG. 3, the operation S10 of determining a picture type of the current frame display picture includes:

Operation S11, obtaining a previous frame display picture;

Operation S12, determining a second pixel of the previous frame display picture corresponding to a first pixel of the current frame display picture, and comparing a pixel value of the first pixel with a pixel value of the second pixel;

Operation S13, determining that the picture type of the current frame display picture is the static picture when a number of first pixels whose pixel values are same as pixel values of second pixels corresponding to the first pixels is greater than a first preset number; and Operation S14, determining that the picture type of the current frame display picture is the dynamic picture when a number of first pixels whose pixel values are different from pixel values of second pixels corresponding to the first pixels is greater than a second preset number.

The display panel obtains the pixel value of each pixel of the previous frame display picture from the DDR, and defines each pixel of the previous frame display picture as the second pixel, and defines each pixel of the current frame display picture as the first pixel. The display panel then determines the second pixel corresponding to the first pixel one by one. The first pixel and the second pixel have the same display position on the display panel. The display panel compares the pixel value of the first pixel with the pixel value of the second pixel. If the pixel value of each first pixel is the same as the pixel value of the second pixel corresponding to the first pixel, it indicates that the current frame display picture has not changed compared with the previous frame display picture, and the picture type of the current frame display picture is the static picture. If the pixel value of the first pixel is different from the pixel value of the second pixel corresponding to the first pixel, it indicates that the current frame display picture has changed compared with the previous frame display picture, and the picture type of the current frame display picture is the dynamic picture.

Besides, the display panel may also determine the number of similarities between the pixel value of the first pixel and the pixel value of the second pixel corresponding to the first pixel. If the number is greater than a first preset number, it is determined that the current frame display picture only changes in a small range compared with the previous frame display picture, that is, the picture type of the current frame display picture is also taken as a static picture. The first preset number can be determined according to the total number of pixels and the proportion threshold. If the number is less than or equal to the first preset number, it can be determined that the current frame display picture has changed in a large range compared with the previous frame display picture, that is, the picture type of the current frame display picture is a dynamic picture.

The display panel may also determine the number of differences between the pixel value of the first pixel and the pixel value of the second pixel corresponding to the first pixel. If the number is greater than a second preset number, it is determined that the current frame display picture has changed in a large range compared with the previous frame display picture, that is, the picture type of the current frame display picture is the dynamic picture. The second preset number can be determined according to the total number of pixels and the proportion threshold. If the number is less than the second preset number, it is determined that the current frame display picture only changes in a small range compared with the previous frame display picture, that is, the picture type of the current frame display picture is the static picture.

Operation S20, determining a target refresh rate according to the picture type.

The display panel can store the mapping relationship between the picture type and the refresh rate. The picture type includes but is not limited to the dynamic picture and the static pictures. The display panel can determine the refresh rate according to the mapping relationship and the picture type. The refresh rate is the target refresh rate.

The picture played on the display panel has a corresponding frame rate. For example, a frame rate of 200 indicates that the display panel theoretically can play 200 frames of pictures in one second. The refresh rate refers to the number of times the electron beam repeatedly scans the image on the screen. The refresh rate is the number of pictures actually played on the display panel in one second. The refresh rate of 60 Hz means that the display panel will actually play 60 pictures within one second. It can be understood that, in general, the display panel selects 60 pictures from the 200 pictures for display. In this embodiment, the refresh rate of the dynamic picture is higher than that of static picture, the reason is that the characters and scenes of the dynamic picture have changed greatly. If the refresh rate is low, for example, the refresh rate is 50 Hz, it indicates that four frames between the previous frame display picture and the current frame display picture are not displayed, which leads to inconsistent movements of the characters displayed on the display panel and even smear phenomenon. Therefore, the refresh rate needs to be increased. However, when the current frame display picture is the static picture, the character or scene changes little, or even unchanged, so the refresh rate is small, and there will be no discontinuous character dynamics or smear phenomenon. At this time, the refresh rate can be appropriately reduced.

Operation S30, determining a target proportion correction value of each primary light according to the target refresh rate, determining a target proportion of each primary light according to the target proportion correction value and a value of the proportion to adjust the white balance of the pixel to be displayed.

In this embodiment, the higher the refresh rate, the shorter the charging time of the thin film transistor corresponding to the pixel, and the corresponding proportion of each primary light corresponding to the pixel will change. The display panel stores the refresh rate, the proportion of each primary light, and the mapping relationship with the proportion correction value of each primary light. After determining the target refresh rate, the display panel can determine the target proportion correction value corresponding to each primary light according to the target refresh rate, the proportion of each primary light and the mapping relationship. Then the display panel corrects the proportion of the corresponding primary light according to the target proportion correction value to obtain the target proportion corresponding to each primary light.

Besides, in this embodiment, only the proportions of red light and blue light can be adjusted to adjust the white balance of the pixel. The reason is that the white balance adjustment actually adjusts the color coordinates, and red light and blue light will affect the color coordinates, while green light does not affect the color coordinates, so only the proportions of red light and blue light needs to be adjusted.

After adjusting the white balance of the pixel, voltage is applied to the corresponding liquid crystal panel according to the proportion of each primary light to complete the display of the pixel on the display panel. When the pixel is the last pixel of the current frame display picture, the next frame to be displayed needs to be displayed. Since the refresh rate of the display panel changes in real time, the display panel needs to determine the display time point of the next frame display picture according to the target refresh rate, and when the current time point reaches the display time point, it can receive the next frame display picture, and the next frame display picture is taken as the current frame display picture, and operation S10 to operation S30 are executed.

In technical solutions of the present disclosure, the display panel determines a proportion of each primary light corresponding to the pixel to be displayed in a current frame display picture, and determines a picture type of the current frame display picture, thereby determines a target refresh rate according to the picture type; and determines a target proportion correction value of each primary light according to the target refresh rate, determines a target proportion of each primary light according to the target proportion correction value and a value of the proportion to adjust the white balance of the pixel to be displayed. Since the display panel can adjust the refresh rate according to the picture type of the current frame display picture, and determine the target proportion correction value of each primary light according to the adjusted refresh rate, the target proportion of each primary light of the pixel to be displayed is adjusted correspondingly with the change of the refresh rate, and the accuracy of the white balance adjustment of the pixel is high.

Figure 4:
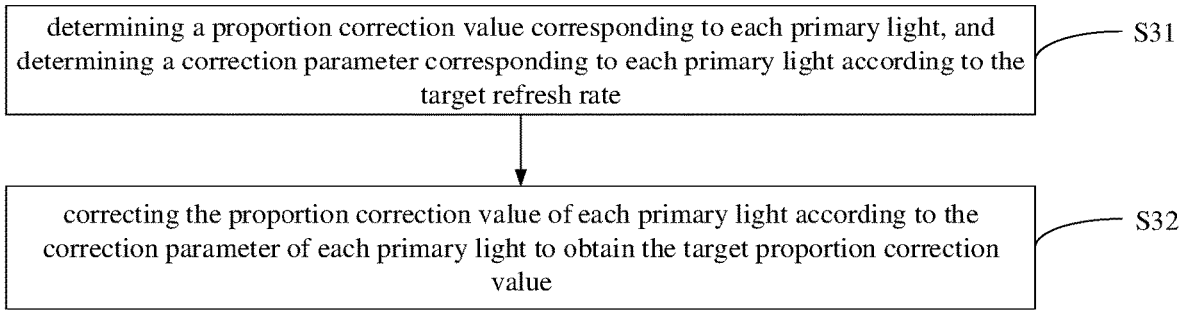
FIG. 4 is a detailed flowchart of the operation S30 of determining a target proportion correction value of each primary light according to the target refresh rate in FIG. 2.

As shown in FIG. 4, FIG. 4 is a detailed flowchart of the operation S30 of determining a target proportion correction value of each primary light according to the target refresh rate in FIG. 2. Operation S30 includes:

Operation S31, determining a proportion correction value corresponding to each primary light, and determining a correction parameter corresponding to each primary light according to the target refresh rate; and Operation S32, correcting the proportion correction value of each primary light according to the correction parameter of each primary light to obtain the target proportion correction value corresponding to each of each primary light.

In this embodiment, the display panel stores a look-up table of the proportion of each primary light of the pixel and the proportion correction value corresponding to each primary light. The display panel can look up the percentage correction values corresponding to each primary light in the look-up table according to the proportion of each primary light of the pixel. The establishment of the lookup table is obtained by testing the display panel at the preset refresh rate. Therefore, the display panel needs to correct the proportion correction value according to the target refresh rate and the preset refresh rate to obtain the target proportion correction value.

The display panel can determine the correction parameter according to the target refresh rate, and the correction parameter can be an increment or decrement value, or a correction coefficient. The correction parameter can be determined according to the size between the target refresh rate and the preset refresh rate. When the target refresh rate is greater than the preset refresh rate, the correction parameter can be the incremental value or the correction coefficient greater than 1. When the target refresh rate is less than the preset refresh rate, the correction parameter is the decrement value or the correction coefficient less than 1.

The display panel superimposes the proportion correction value with the increment or decrement value to obtain the target proportion correction value. Alternatively, the display panel multiplies the proportion correction value by the correction coefficient to obtain the target proportion correction value.

It should be noted that the target refresh rate and the correction parameter have a positive correlation. The larger the difference between the target refresh rate and the preset refresh rate, the larger the compensation parameter. The correction parameter is determined according to the difference between the target refresh rate and the preset refresh rate.

In technical solutions of the present disclosure, the display panel determines the correction parameter according to the target refresh rate, thereby correcting the proportion correction value according to the correction parameter to obtain the target proportion correction value.

In an embodiment, the display panel compares the target refresh rate with the preset refresh rate. If the target refresh rate is greater than the preset refresh rate, it means that the charging time of the pixel corresponding to the target refresh rate is shorter than the charging time of the pixel corresponding to the preset refresh rate, therefore, it is necessary to increase the proportion correction value to obtain the target proportion correction value, and the increase amount can be determined according to the difference between the charging duration of the two. The increase amount of the proportion correction value of each primary light is different.

If the target refresh rate is less than the preset refresh rate, it means that the charging time of the pixel corresponding to the target refresh rate is greater than the charging time of the pixel corresponding to the preset refresh rate, therefore, it is necessary to decrease the proportion correction value to obtain the target proportion correction value, and the decrease amount can be determined according to the difference between the charging duration of the two. The decrease amount of the proportion correction value of each primary light is different.

When the target refresh rate is equal to the preset refresh rate, the proportion correction value corresponding to each primary light is the target percentage correction value.

Figure 5:
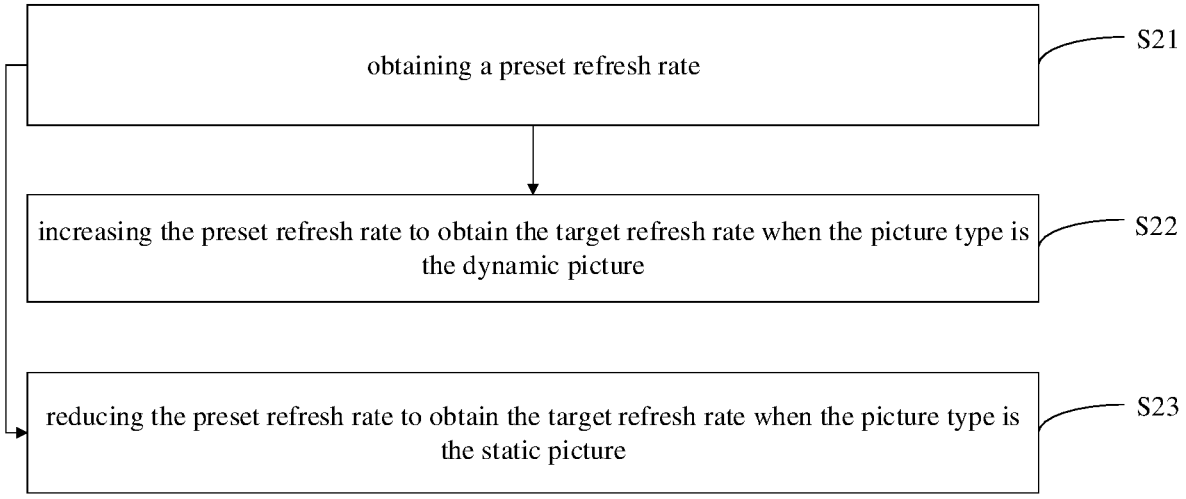
FIG. 5 is a detailed flowchart of the operation S20 in FIG. 2.

As shown in FIG. 5, FIG. 5 is a detailed flowchart of the operation S20 in FIG. 2. Operation S20 includes:

Operation S21, obtaining a preset refresh rate;

Operation S22, increasing the preset refresh rate to obtain the target refresh rate when the picture type is a dynamic picture; and Operation S23, reducing the preset refresh rate to obtain the target refresh rate when the picture type is a static picture.

In this embodiment, a preset refresh rate is set in the display panel. After the display panel determines the picture type of the current frame display picture, it can modify the preset refresh rate according to the picture type to obtain the target refresh rate. Specifically, when the picture type is a static picture, the preset refresh rate is reduced to obtain the target refresh rate. When the picture type is a dynamic screen, the preset refresh rate is increased to obtain the target refresh rate. That is, the refresh rate corresponding to the dynamic picture is greater than the refresh rate corresponding to the static picture. The principle that the refresh rate corresponding to the dynamic picture is greater than the refresh rate corresponding to the static picture is described above, and will not be repeated here.

In technical solutions of the present disclosure, the display panel determines the preset refresh rate, the preset refresh rate is reduced when the picture type is the static picture, and the preset refresh rate is increased when the picture type is the dynamic picture. The display panel reasonably adjusts the refresh rate according to the current frame display picture.

In an embodiment, when the current frame display picture is a static picture, the decrease amount of the preset refresh rate can be determined according to the number of pixels that have changed in the current frame display picture. The change here refers to the pixels that have changed in the current frame display picture compared with the previous frame display picture. The display panel calculates the number of first pixels whose pixel values are different from pixel values of second pixels corresponding to the first pixels, and obtains the first proportion through dividing the total number of pixels of the display picture by the number of first pixels whose pixel values are different from pixel values of second pixels corresponding to the first pixels. There is a mapping relationship between the first proportion and the decrease amount. The display panel can determine the decrease amount according to the first proportion. The larger the first proportion, the larger the preset refresh rate after reduction, that is, the proportion is positively correlated with the target refresh rate. The display panel can also determine the number of first pixels whose pixel values are same as pixel values of second pixels corresponding to the first pixels so as to obtain the second proportion. There is a mapping relationship between the second proportion and the decrease amount, and thus the preset refresh rate is reduced according to the second proportion to obtain the target refresh rate. The larger the second proportion, the smaller the target refresh rate.

Similarly, when the current frame display picture is the dynamic picture, the display panel can obtain the corresponding increase amount according to the above principle. The larger a third proportion corresponding to a number of similarities between the pixel value of the first pixel and the pixel value of the second pixel corresponding to the first pixel, the larger the target refresh rate. The larger a fourth proportion corresponding to a number of differences between the pixel value of the first pixel and the pixel value of the second pixel corresponding to the first pixel, the smaller the target refresh rate.

The present disclosure further provides a display panel, including a memory and at least one processor. The memory stores computer-executable instructions that can be executed by the at least one processor, and when the computer-executable instructions are executed by the at least one processor, the processor performs the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

The present disclosure further provides a computer readable storage medium. The computer-readable storage medium has computer-executable instructions that can be executed by at least one processor, and when the computer-executable instructions are executed by the at least one processor, the processor performs the following operations:

determining a proportion of each primary light corresponding to a pixel to be displayed in a current frame display picture, and determining a picture type of the current frame display picture;

determining a target refresh rate according to the picture type; and determining a target proportion correction value of each primary light according to the target refresh rate, determining a target proportion of each primary light according to the target proportion correction value and a value of the proportion to adjust the white balance of the pixel to be displayed.

The serial numbers of the foregoing embodiments of the present disclosure are only for description, and do not represent the advantages and disadvantages of the embodiments.

It should be noted that in this document, the terms "comprise", "include" or any other variants thereof are intended to cover a non-exclusive inclusion. Thus, a process, method, article, or system that includes a series of elements not only includes those elements, but also includes other elements that are not explicitly listed, or also includes elements inherent to the process, method, article, or system. If there are no more restrictions, the element defined by the sentence "including a . . . " does not exclude the existence of other identical elements in the process, method, article or system that includes the element.

Through the description of the above embodiment, those skilled in the art can clearly understand that the above-mentioned embodiments can be implemented by software plus a necessary general hardware platform, of course, it can also be implemented by hardware, but in many cases the former is a better implementation. Based on this understanding, the technical solution of the present disclosure can be embodied in the form of software product in essence or the part that contributes to the existing technology. The computer software product is stored on a storage medium (such as ROM/RAM, magnetic disk, optical disk) as described above, including several instructions to cause a terminal device (which can be a mobile phone, a computer, a server, a TV, or a network device, etc.) to execute the method described in each embodiment of the present disclosure.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A method for adjusting a white balance of a pixel, comprising the following operations:

determining a proportion of each primary light corresponding to a pixel to be displayed in a current frame display picture, and determining a picture type of the current frame display picture;

determining a target refresh rate according to the picture type;

determining a proportion correction value corresponding to each primary light, and determining a correction parameter corresponding to each primary light according to the target refresh rate; and correcting the proportion correction value of each primary light according to the correction parameter of each primary light to obtain the target proportion correction value, and determining a target proportion of each primary light according to the target proportion correction value and a value of the proportion to adjust the white balance of the pixel to be displayed.

2. The method of claim 1, wherein the operation of determining a proportion correction value corresponding to each primary light comprises:

determining a look-up table of the proportion and the proportion correction value of each primary light; and determining the proportion correction value of each primary light in the look-up table according to the proportion of each primary light corresponding to the pixel to be displayed.

3. The method of claim 1, wherein the operation of determining a correction parameter corresponding to each primary light according to the target refresh rate comprises:

obtaining a preset refresh rate; and determining the correction parameter corresponding to each primary light according to a difference between the target refresh rate and the preset refresh rate.

4. The method of claim 1, wherein when adjusting the white balance of the pixel to be displayed, proportions of blue light and red light corresponding to the pixel to be displayed are adjusted.

5. The method of claim 1, wherein the picture type includes a dynamic picture and a static picture, the operation of determining a target refresh rate according to the picture type comprises:

obtaining a preset refresh rate;

increasing the preset refresh rate to obtain the target refresh rate when the picture type is the dynamic picture; and reducing the preset refresh rate to obtain the target refresh rate when the picture type is the static picture.

6. The method of claim 1, wherein the operation of determining a picture type of the current frame display picture comprises:

obtaining a previous frame display picture;

determining a second pixel of the previous frame display picture corresponding to a first pixel of the current frame display picture, and comparing a pixel value of the first pixel with a pixel value of the second pixel;

determining that the picture type of the current frame display picture is a static picture when a number of first pixels whose pixel values are same as pixel values of second pixels corresponding to the first pixels is greater than a first preset number; and determining that the picture type of the current frame display picture is a dynamic picture when a number of first pixels whose pixel values are different from pixel values of second pixels corresponding to the first pixels is greater than a second preset number.

7. The method of claim 1, wherein after the operation of determining a target proportion of each primary light according to the target proportion correction value and a value of the proportion to adjust the white balance of the pixel to be displayed, the method further comprises:

determining a display time point of a next frame display picture according to the target refresh rate after the white balance of the pixel to be displayed is adjusted, and after each pixel on the current frame display picture is displayed on a display panel; and taking the next frame display picture as the current frame display picture when the display time point arrives, to perform the operation of determining a proportion of each primary light corresponding to a pixel to be displayed in a current frame display picture.

8. A display device, wherein the display device comprises a memory and at least one processor, the memory stores computer-executable instructions executed by the at least one processor, and when the computer-executable instructions are executed by the at least one processor, the at least one processor performs the following operations:

determining a proportion of each primary light corresponding to a pixel to be displayed in a current frame display picture, and determining a picture type of the current frame display picture;

determining a target refresh rate according to the picture type;

determining a proportion correction value corresponding to each primary light, and determining a correction parameter corresponding to each primary light according to the target refresh rate; and correcting the proportion correction value of each primary light according to the correction parameter of each primary light to obtain the target proportion correction value, and determining a target proportion of each primary light according to the target proportion correction value and a value of the proportion to adjust the white balance of the pixel to be displayed.

9. The display device of claim 8, wherein the operation of determining a proportion correction value corresponding to each primary light comprises:

determining a look-up table of the proportion and the proportion correction value of each primary light; and determining the proportion correction value of each primary light in the look-up table according to the proportion of each primary light corresponding to the pixel to be displayed.

10. The display device of claim 8, wherein the operation of determining a correction parameter corresponding to each primary light according to the target refresh rate comprises:

obtaining a preset refresh rate; and determining the correction parameter corresponding to each primary light according to a difference between the target refresh rate and the preset refresh rate.

11. The display device of claim 8, wherein when adjusting the white balance of the pixel to be displayed, proportions of blue light and red light corresponding to the pixel to be displayed are adjusted.

12. The display device of claim 8, wherein the picture type includes a dynamic picture and a static picture, the operation of determining a target refresh rate according to the picture type comprises:

obtaining a preset refresh rate;

increasing the preset refresh rate to obtain the target refresh rate when the picture type is the dynamic picture; and reducing the preset refresh rate to obtain the target refresh rate when the picture type is the static picture.

13. A non-transitory computer readable storage medium, wherein the non-transitory computer readable storage medium comprises computer-executable instructions executed by at least one processor, and when the computer-executable instructions are executed by the at least one processor, the at least one processor performs the following operations: determining a proportion of each primary light corresponding to a pixel to be displayed in a current frame display picture, and determining a picture type of the current frame display picture; determining a target refresh rate according to the picture type; determining a proportion correction value corresponding to each primary light, and determining a correction parameter corresponding to each primary light according to the target refresh rate; and correcting the proportion correction value of each primary light according to the correction parameter of each primary light to obtain the target proportion correction value, and determining a target proportion correction value of each primary light according to the target refresh rate, determining a target proportion of each primary light according to the target proportion correction value and a value of the proportion to adjust the white balance of the pixel to be displayed.

14. The computer readable storage medium of claim 13, wherein the operation of determining a proportion correction value corresponding to each primary light comprises:

determining a look-up table of the proportion and the proportion correction value of each primary light; and determining the proportion correction value of each primary light in the look-up table according to the proportion of each primary light corresponding to the pixel to be displayed.

15. The computer readable storage medium of claim 13, wherein the operation of determining a correction parameter corresponding to each primary light according to the target refresh rate comprises:

obtaining a preset refresh rate; and determining the correction parameter corresponding to each primary light according to a difference between the target refresh rate and the preset refresh rate.

16. The computer readable storage medium of claim 13, wherein when adjusting the white balance of the pixel to be displayed, proportions of blue light and red light corresponding to the pixel to be displayed are adjusted.

17. The computer readable storage medium of claim 13, wherein the picture type includes a dynamic picture and a static picture, the operation of determining a target refresh rate according to the picture type comprises:

obtaining a preset refresh rate;

increasing the preset refresh rate to obtain the target refresh rate when the picture type is the dynamic picture; and reducing the preset refresh rate to obtain the target refresh rate when the picture type is the static picture.

* * * * *